US008167387B1

(12) United States Patent
Quinn

(10) Patent No.: US 8,167,387 B1
(45) **Date of Patent: *May 1, 2012**

(54) COLLAPSIBLE STORAGE CONTAINER

(75) Inventor: Charles T Quinn, Dover, MA (US)

(73) Assignee: Franklin Sports, Inc., Stoughton, MA (US)

( * ) Notice: Subject to any disclaimer, the term of this patent is extended or adjusted under 35 U.S.C. 154(b) by 707 days.

This patent is subject to a terminal disclaimer.

(21) Appl. No.: 12/254,846

(22) Filed: Oct. 21, 2008

Related U.S. Application Data

(63) Continuation-in-part of application No. 11/699,296, filed on Jan. 29, 2007, now Pat. No. 7,464,999.

(51) Int. Cl.
*A47B 43/00* (2006.01)

(52) U.S. Cl. ..... 312/258

(58) Field of Classification Search ..... 312/257.1, 312/258, 259, 262, 263, 111; 217/12 A, 217/12 R, 13, 14; 206/600; 220/4.29, 6
See application file for complete search history.

(56) References Cited

U.S. PATENT DOCUMENTS

| | | | | |
|---|---|---|---|---|
| 889,741 | A | 6/1908 | Additon | |
| 933,210 | A | 9/1909 | Ullom | |
| 1,335,137 | A * | 3/1920 | Stubbs | 217/14 |
| 1,342,269 | A | 6/1920 | Stewart | |
| 1,822,585 | A | 9/1931 | Douglas et al. | |
| 2,934,389 | A | 4/1960 | Krey | |
| 3,294,464 | A | 12/1966 | Harold | |
| 3,611,994 | A | 10/1971 | Bailey et al. | |
| 4,400,043 | A | 8/1983 | Rossow | |
| 4,720,020 | A | 1/1988 | Su | |
| 5,016,570 | A | 5/1991 | Henson | |
| 5,257,830 | A | 11/1993 | Pflueger | |
| 5,595,305 | A | 1/1997 | Hart | |
| 6,006,918 | A | 12/1999 | Hart | |
| 6,056,177 | A | 5/2000 | Schneider | |
| 6,691,885 | B2 | 2/2004 | Brown | |
| 6,726,046 | B2 | 4/2004 | Orset | |
| 6,938,789 | B1 | 9/2005 | Matias et al. | |

* cited by examiner

*Primary Examiner* — James O Hansen
(74) *Attorney, Agent, or Firm* — Joseph B Bowman

(57) ABSTRACT

A portable and collapsible storage container formed of rigid, interconnected panels which, when fully assembled, form a self-standing, integrally strong unit and, when collapsed, fold together to occupy a minimal volumetric space. Opposed side walls are hingedly connected to a front frame, and opposed end walls are hingedly connected to a rear wall panel, both to fold inwardly in interlocking fashion such that the side walls overlie the rear panel and the end walls overlie the side walls within the region bounded by the front frame. The storage container may optionally include a door or lid for closure which may be fitted with a lock if desirable. The side walls include means for supporting a removable interior panel to prevent the side walls from folding inwardly which, in turn, prevent the end walls from folding inwardly.

3 Claims, 9 Drawing Sheets

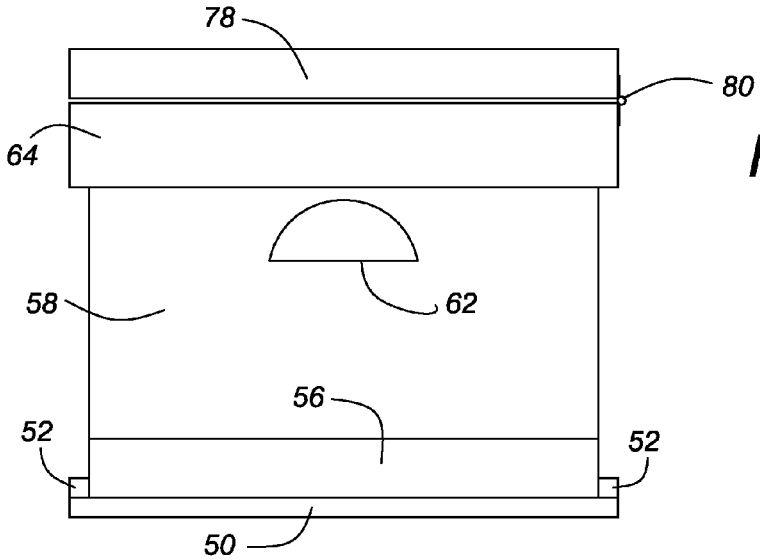
Fig.11
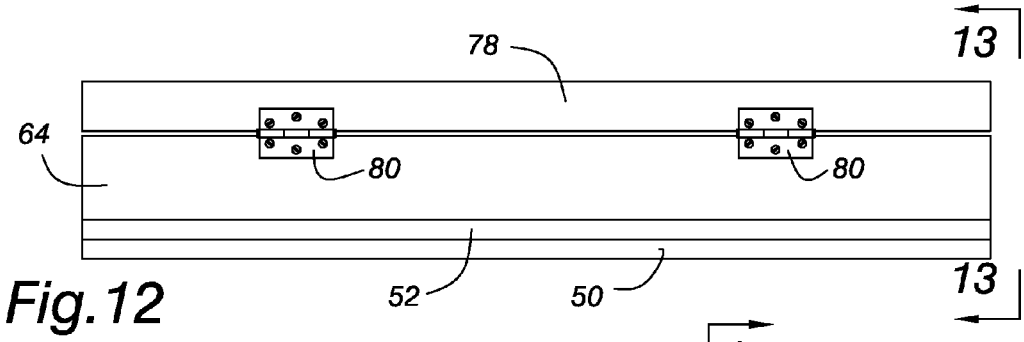
Fig.12
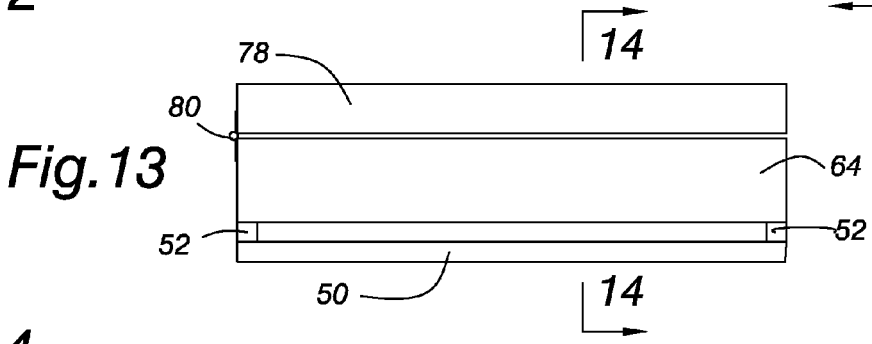
Fig.13
Fig.14
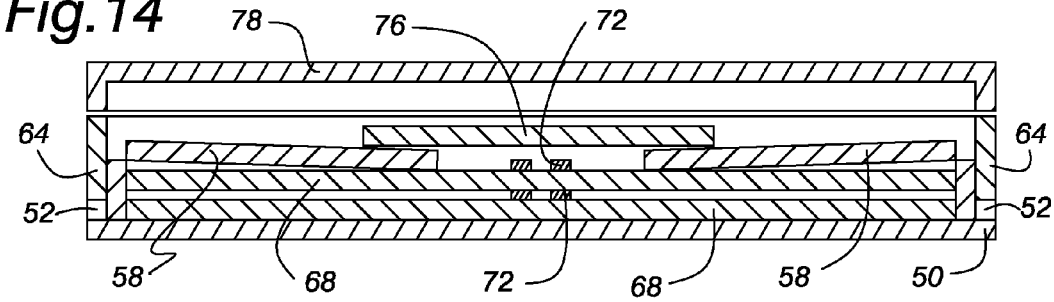

COLLAPSIBLE STORAGE CONTAINER

CROSS-REFERENCE TO RELATED APPLICATIONS

This application is a continuation-in-part application of Ser. No. 11/699,296, filed Jan. 29, 2007 now U.S. Pat. No. 7,464,999 and entitled "Collapsible Storage Locker".

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to a portable storage container. More specifically, this invention relates to a collapsible storage container to minimize volumetric space occupied by the locker during shipment or when not in use.

The storage containers of this invention may be in the form of upright storage lockers or horizontal footlockers and file storage boxes. Storage lockers are found in schools, gyms, a wide variety of sports facilities such as golf and tennis clubs, and public transportation facilities such as airports or bus and train stations for short or long term storage of an individual's personal gear. Typically, the contents may be secured by a padlock, combination lock, or flush key lock.

Storage lockers, or similar storage cabinets, containers and boxes of this genre are characteristically separate, flat panels assembled together by various hardware such as angle brackets, nuts and bolts, or nails and screws depending upon the material of construction. The materials of construction for storage lockers in general can include wooden, metal or plastic panels, or combinations of these materials. Locker installations may include self assembly of pre-formed panels, as well as custom units requiring installation by skilled labor. In either case, installation has heretofore proven to be time consuming and occasionally complex requiring the assembly of a number of parts during the construction process.

Portability of storage lockers is frequently required when the need for temporary use arises or when relocation becomes necessary. Here, not only the time and complexity of assembly of the unit is important, but the time and complexity of disassembly is of equal concern. As an outgrowth of portability, minimizing the volumetric space occupied by the storage unit during shipment or transport becomes an important consideration.

In the past, various collapsible storage containers have been developed for portability and for conserving space during shipment. However, such units suffer a variety of drawbacks. Some require panels hinged in the middle which compromises the rigid integrity of conventional panel construction. For example, U.S. Pat. No. 6,938,789 by Matias et al. teaches a collapsible shipping box having hinged end walls. While no doubt satisfactory for a shipping box, the Matias et al. construction lacks rigidity in its ends walls which proves unsatisfactory for the necessary structural integrity required for storage lockers.

Other collapsible storage constructions for specialized uses as found in the prior art may include hinged and rigid planar walls, but require uniquely configured and specially fabricated separate bases in order to provide structural integrity to the assembled unit. U.S. Pat. Nos. 5,595,305 and 6,006,918 disclose such structures and still require separate parts for assembly of the completed unit.

Therefore, a need remains in the field of storage units for a portable, collapsible storage container that is fully integrated without separate parts or panels, yet is easily assembled and disassembled by an ordinary person without specialized skills or tools. The primary objective of this invention is to meet this need.

SUMMARY OF THE INVENTION

More specifically, an object of the invention is to provide a portable and collapsible storage container which may be quickly and easily assembled and disassembled for storage.

Another object of the invention is to provide a portable and collapsible storage container which may be assembled and disassembled without the aid of tools or specialized skill.

An additional object of the invention is to provide a portable and collapsible storage container to minimize volumetric space occupied by the locker during shipment or when not in use.

Yet another object of the invention is to provide a storage container of the character described which is fully self-contained with few, if any, separate parts.

A corollary object is to provide a storage container of the character described which, when assembled, has a sturdy and rigid, unitary construction without the use of separate connectors such as bolts, screws or like fasteners.

In summary, an object of the invention is to provide a portable and collapsible storage container formed of rigid, interconnected panels which, when fully assembled, form a self-standing, integrally strong unit and, when collapsed, fold together to occupy a minimal volumetric space. Opposed side walls are hingedly connected to a front frame, and opposed end walls are hingedly connected to a rear wall panel, both to fold inwardly in interlocking fashion such that the side walls overlie the rear panel and the end walls overlie the side walls within the region bounded by the front frame. The storage container may optionally include a door or lid for closure which may be fitted with a lock if desirable. The side walls include means for supporting a removable interior panel to prevent the side walls from folding inwardly which, in turn, prevent the end walls from folding inwardly.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views:

FIG. 11 is an end elevational view taken along line 11-11 of FIG. 9 in the direction of the arrows;

FIG. 12 is a rear elevational view of the storage box in a collapsed condition;

FIG. 13 is a side elevational view of the storage box in a collapsed condition taken along line 13-13 of FIG. 12 in the direction of the arrows;

FIG. 14 is a sectional view taken along line 14-14 of FIG. 13 in the direction of the arrows to illustrate the relative positions of the side and end wall panels disposed in the collapsed condition.

DETAILED DESCRIPTION OF THE DRAWINGS

Figure 1:
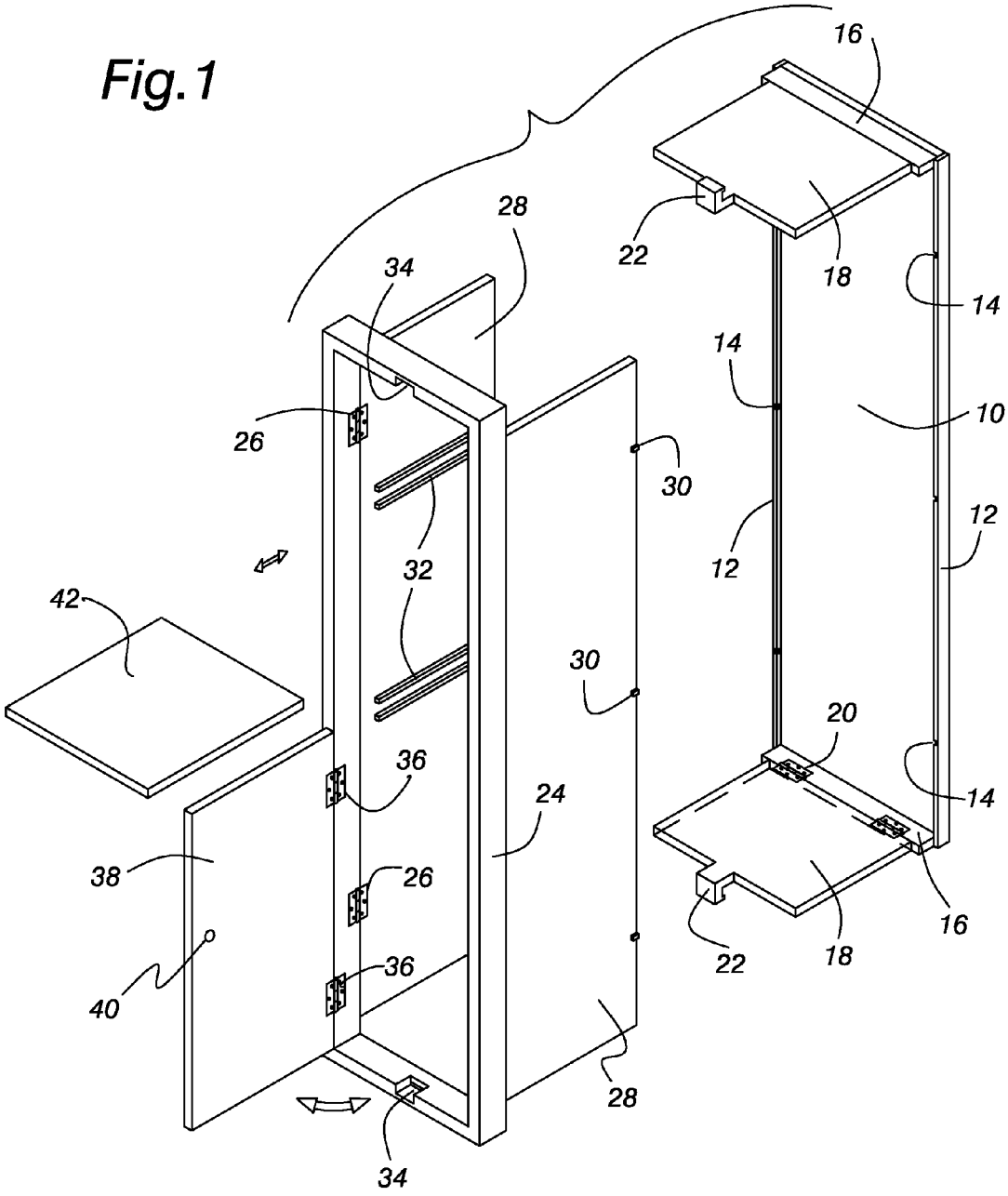
FIG. 1 is an exploded perspective view of a collapsible storage locker constructed in accordance with one embodiment of the invention, with only one of two shelves illustrated for the purpose of clarity.
Figure 2:
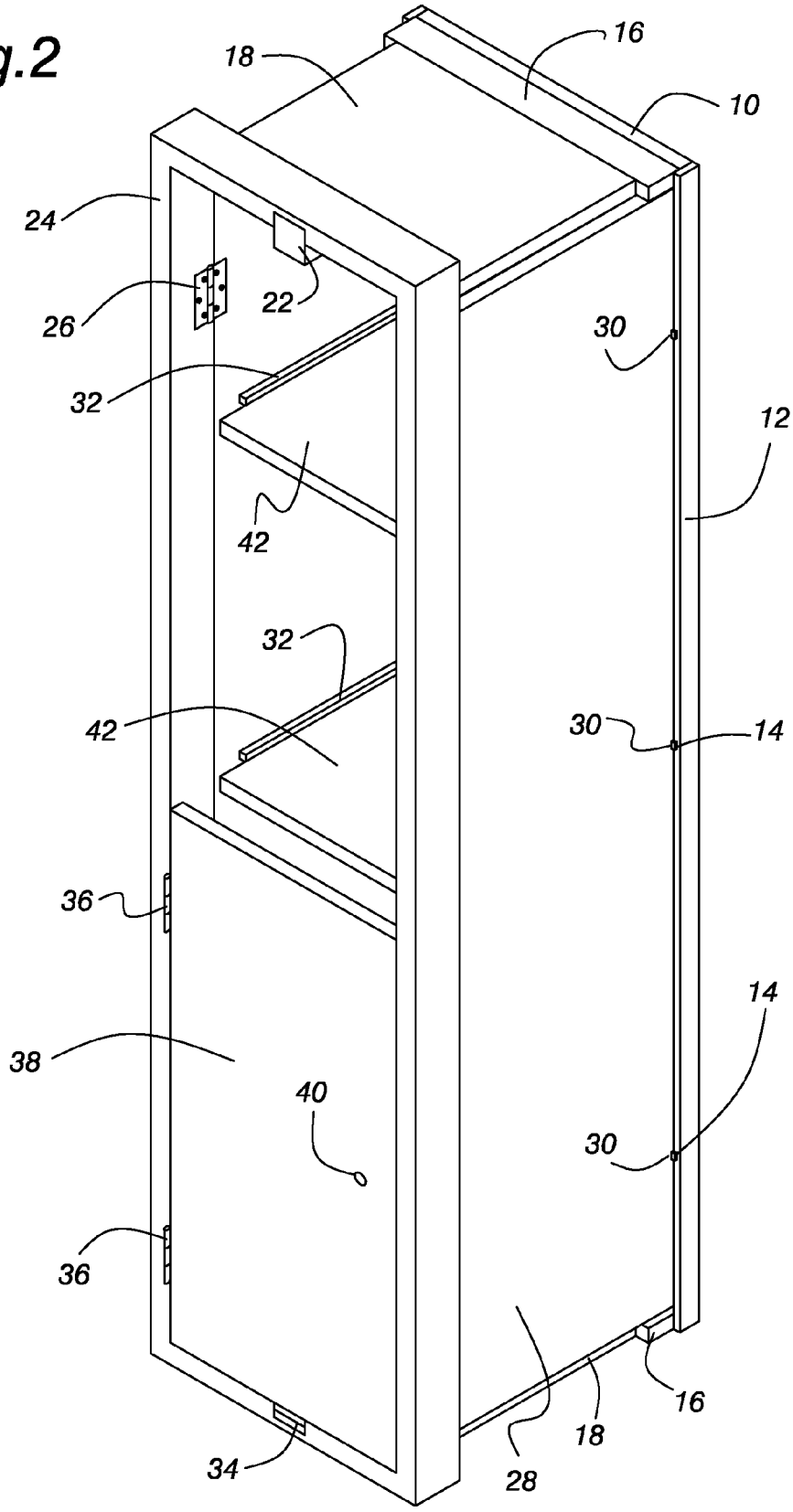
FIG. 2 is a front perspective view of the storage locker in a fully assembled condition.
Figure 3:
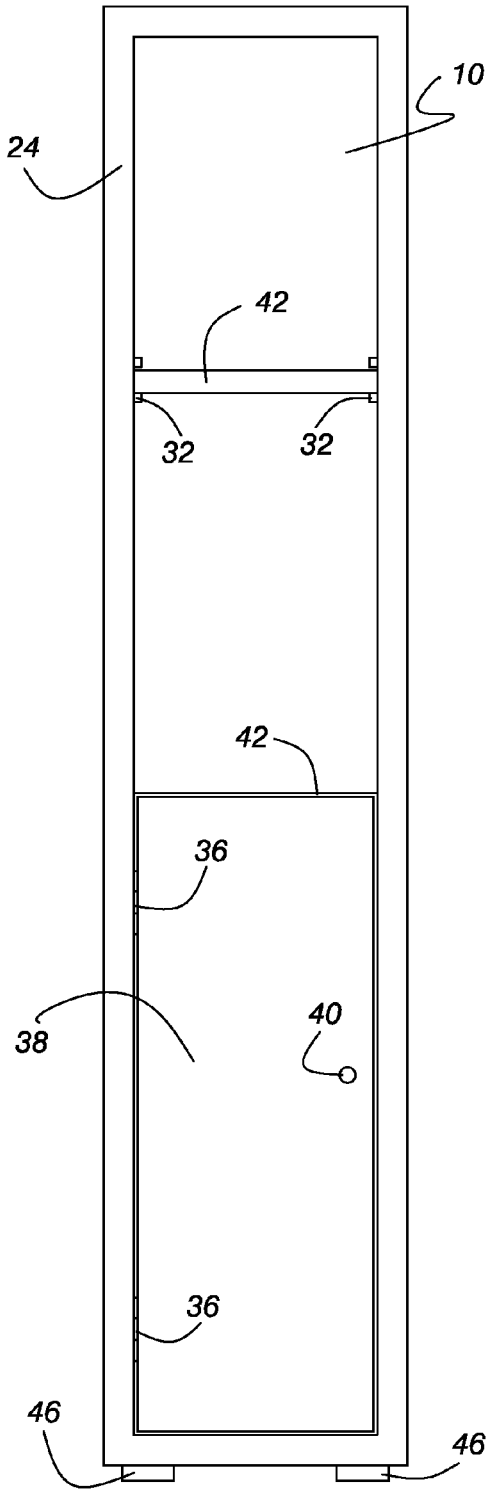
FIG. 3 is a front elevational view of the assembled storage locker.

Referring to the drawings in greater detail, attention is first directed to the illustration of FIG. 1 showing an exploded view of the storage locker to provide a better understanding of how the unit interlocks when assembled. Beginning at the back of the storage locker, there is provided a rigid, rear wall panel 10 having a preselected width and height for a conveniently sized locker.

Joined to the opposed side edges of the rear wall panel 10 are opposed rail members 12 each having a plurality of spaced notches 14 along the inwardly facing edges of the rails 12. Integrally joined to the top and bottom edges of the rear wall panel 10 are opposed spacer members 16.

End wall panels 18 are connected by hinges 20 the opposed spacer members 16 extending from the rear wall 10. The leading edge of each end wall 18 includes a centrally formed projection as a hook-shaped key 22. For the uppermost end wall panel 18, the bight of the hook-shaped key 22 is oriented upwardly and for the lowermost end wall panel 18, the bight of the hook-shaped key 22 is oriented downwardly.

Moving forwardly from the rear panel 10 to the second assemblage shown in FIG. 1, the storage locker includes an integral front frame 24 generally of rectangular shape, and being taller than it is wide as is characteristic of a convenient locker size. Mounted by hinges 26 to pivot inwardly on the rearward edges of the sides of the front frame 24 are a pair of opposed side walls 28. Along the rearmost, exterior edges of the side walls 28 are spaced locking projections 30 which correspond in size and location to register with the spaced notches 14 associated with the side rails 12 of the rear panel 10. On the interior surfaces of the side walls 28 are secured one or more sets of shelf support rails 32 located at a convenient height.

Formed into the top and bottom horizontal members of the front frame 24 are notched keyways 34. The keyways 34 are so sized and positioned as to permit the keys 22 on the top and bottom end walls 18 to be lockingly received therein when the storage locker is fully assembled.

Mounted by hinges 36 to the inside surface of one vertical side member of the front frame 24 is a pivotal closure door 38. The door 38 may extend the entire height of the front frame 24, or alternatively as illustrated, the door 38 may be of a partial height. Likewise, the door 38 may be provided with a simple finger opening 40 as illustrated, or be fitted with a key lock (not shown) within the opening 40 having a locking dog to register with a notch in the front frame 24 as is conventionally known in the closure door arts.

The first preferred embodiment includes one or more removable shelves 42, only one of which is illustrated in FIG. 1 but two are shown in the remaining figures. The shelf 42, as indicated in the drawing, may be slid between the opposed side walls 28 and supportingly received by opposed sets of support rails 32 mounted on the interior surfaces of the side walls 28.

In order for the two assemblages of FIG. 1 to be brought together in interlocking relationship and to permit subsequent collapse of the storage locker, a number of critical dimensional relationships exist between the parts. Those will now be discussed.

First, the width of the side wall panels 28 must be less than the width of the rear panel 10 so that each of the side wall panels 28 overlie the rear panel 10 between the opposed rails 12 when in the collapsed or stowed condition. Also, the side wall panels 28 must be less than the height of the rear panel 10 so that each of the side wall panels 28 fit between the opposed spacer members 16 when in the stowed condition.

Second, the width of the end wall panels 18 must likewise be less than the width of the rear panel 10 and the height of the end panels 18 must be less than or equal to one half height of the rear panel 10 in order to overlie the side wall panels 28 when in the collapsed condition.

Third, in order to set the end wall panels 18 out from the rear wall 10 a sufficient distance to fold on the hinges 20 and overlie the side wall panels 28 in the stowed condition, the spacer members must extend from the rear wall 10 a distance at least equal to twice the thickness of the side wall panels 28.

Fourth, the front frame 24 must provide an open width at least equal to the width of the end wall panels 18 and an open height at least equal to the height of the rear wall panel 10 plus twice the thickness of the end wall panels 18.

And lastly, the width of the shelf 42 or shelves 42 must be sufficient to span the distance between the side panels 28 when in the assembled condition in order to maintain the locking projections 30 in biasing engagement with the spaced notches 14 of the rails 12 affixed to opposite sides of the rear panel 10.

Figure 4:
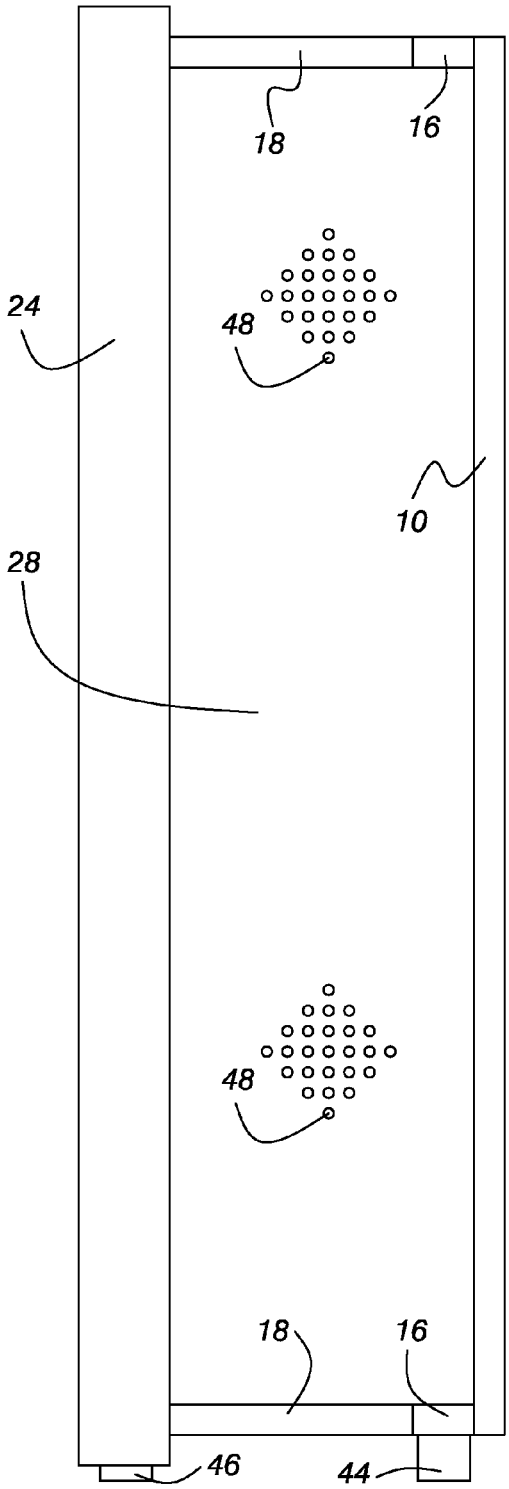
FIG. 4 is a side elevational view of the assembled storage locker.
Figure 5:
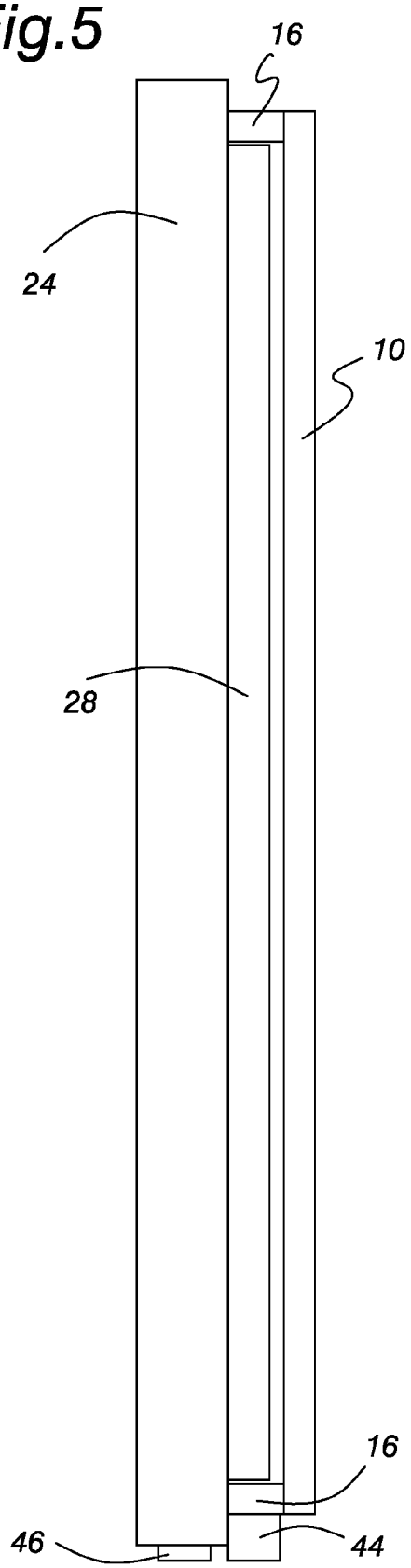
FIG. 5 is a side elevational view of the storage locker in a collapsed condition.
Figure 6:
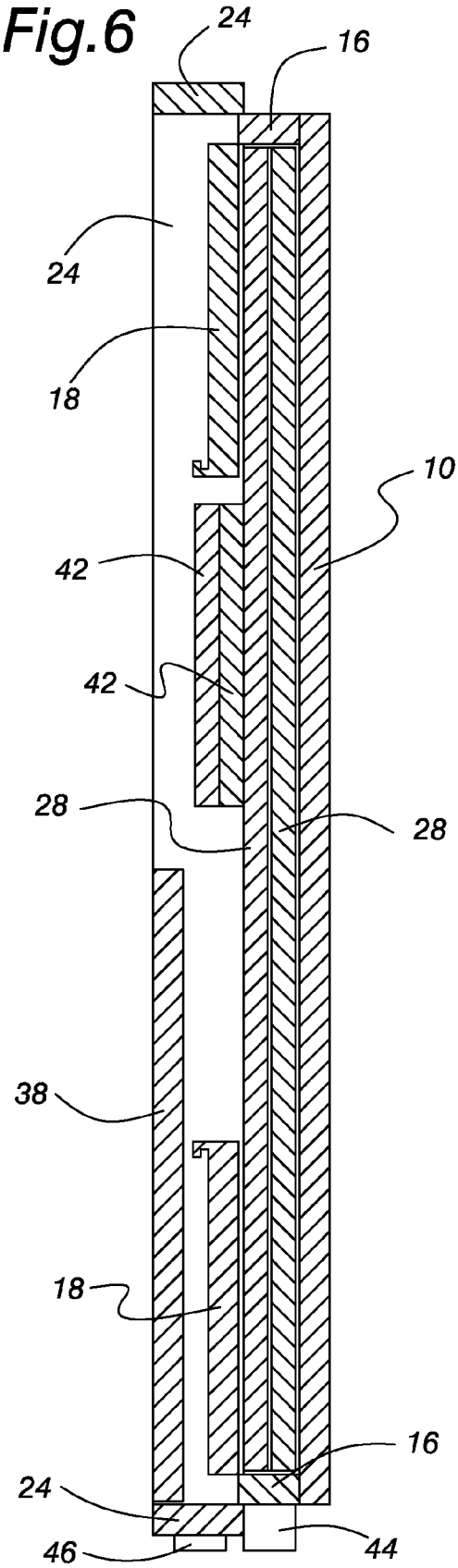
FIG. 6 is a side sectional view of the collapsed storage locker taken midway through the unit to illustrate how the various wall panels are positioned in the collapsed condition.

As a result of the foregoing dimensional requirements, the rear panel support feet 44 attached to the lowermost spacer member 16 of the rear panel 10, as shown in FIGS. 4-6, are slightly taller than the corresponding front frame support feet 46 secured to the front frame 24. This maintains the storage unit level when fully assembled.

As illustrated in FIG. 4, one or both of the side wall panels 28 may include ventilation holes 48 for air circulation through the storage locker. Likewise, the door 38, end panels 18, or rear wall 10 may also include such ventilation means.

In operation, going from the fully assembled condition as shown in the drawings to the collapsed condition, the door 38 is first opened and any shelves 42 are removed. Next, the side walls 28 are folded inwardly so they are substantially parallel rather than perpendicular to the rear panel 10. The front frame 24 and the now folded side walls 28 are then pushed toward the rear wall 10 by disengaging the keys 22 of the end panels 18 from the keyways 34 of the front frame 24 until the folded side walls 28 overlie the rear panel 10 in close proximity. At this point, the end walls 18 extend through the open width of the front frame 24. When the front frame 24 and the folded side walls 28 are pushed to a point where the side walls 28 are fully between the spacer members 16, then the end wall panels 18 may be folded inwardly on their respective hinges 20 to overlie the side walls 28. The shelves 42 can now be placed flat within the open width and height of the front frame 24 and the door 38 can be closed once again thereby completing the steps necessary to bring the storage locker to its stowed condition.

Assembly from the stowed condition is basically the reverse of the foregoing process. The closure door 38 is opened and any shelves present are removed. Next, the end walls 18 are folded outwardly until they are oriented substantially perpendicular to the rear wall 10. The front frame 24 and the folded side walls 28 are then moved away from the rear wall 10 until the keys 22 on the end walls 18 are received within the keyways 34 of the front frame 24. At this point, the side walls 28 may be folded outwardly until the projections 30 are received in the notches 14 of the rails 12 affixed to the rear wall 10. The shelf 42 or shelves 42 may then be inserted into the support rails 32 in order to prevent the side walls 28 from collapsing inwardly.

In an alternative embodiment, the shelf 42 or shelves 42 may be optionally hinged to one or the other of the side walls 28 rather than being slideably received by the support rails 32. This slightly changes one of the critical dimensions of the parts as previously discussed. Since the shelves 42 will fold against one of the side walls 28 when in the stowed condition, the spacer members 16 must now be dimensioned to extend away from the rear wall 10 a distance at least equal to twice the thickness of the side walls 28 plus the thickness of the shelves 42.

Operationally, going from the fully assembled condition, the door 38 is first opened and any shelves 42 are folded to overlie the side wall 28 on which they are hingedly mounted. The side walls 28 are then folded inwardly and the steps previously described are performed. In going from the stowed condition to full assembly, the steps previously discussed are first carried out. After the side walls 28 are folded out to engage the rails 12, then the shelf 42 or shelves 42 may be folded perpendicular to the side wall 28 from which they are hinged to be supported by a brace or rail support on the opposite side wall 28. This causes the shelf 42 to bias the side walls 28 to engagement with the opposed rails 12 so that the projections 30 remain interlocked within the notches 14 of the rails 12.

Figure 7:
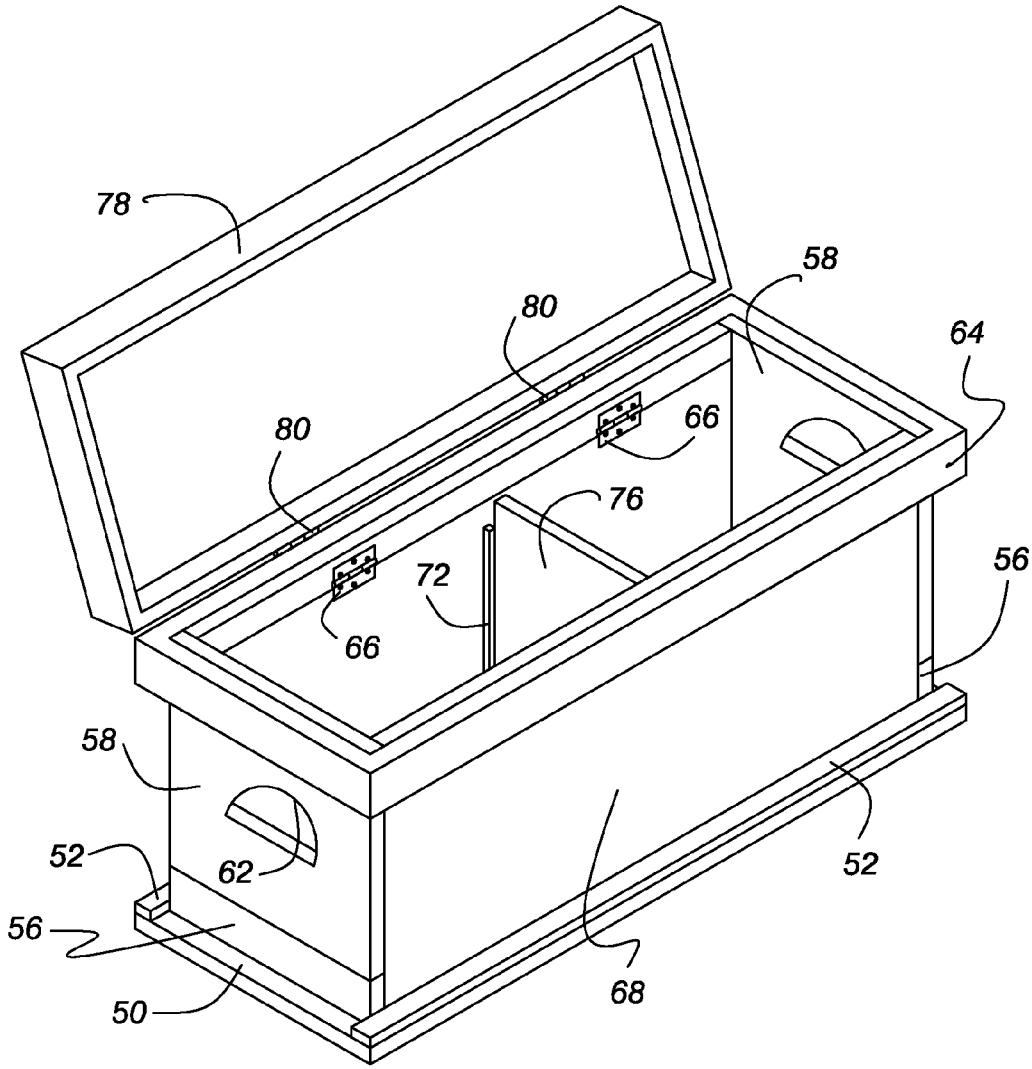
FIG. 7 is a front perspective view of a second embodiment of the invention illustrating a collapsible footlocker or file storage box in a fully assembled condition with the optional lid shown open.
Figure 8:
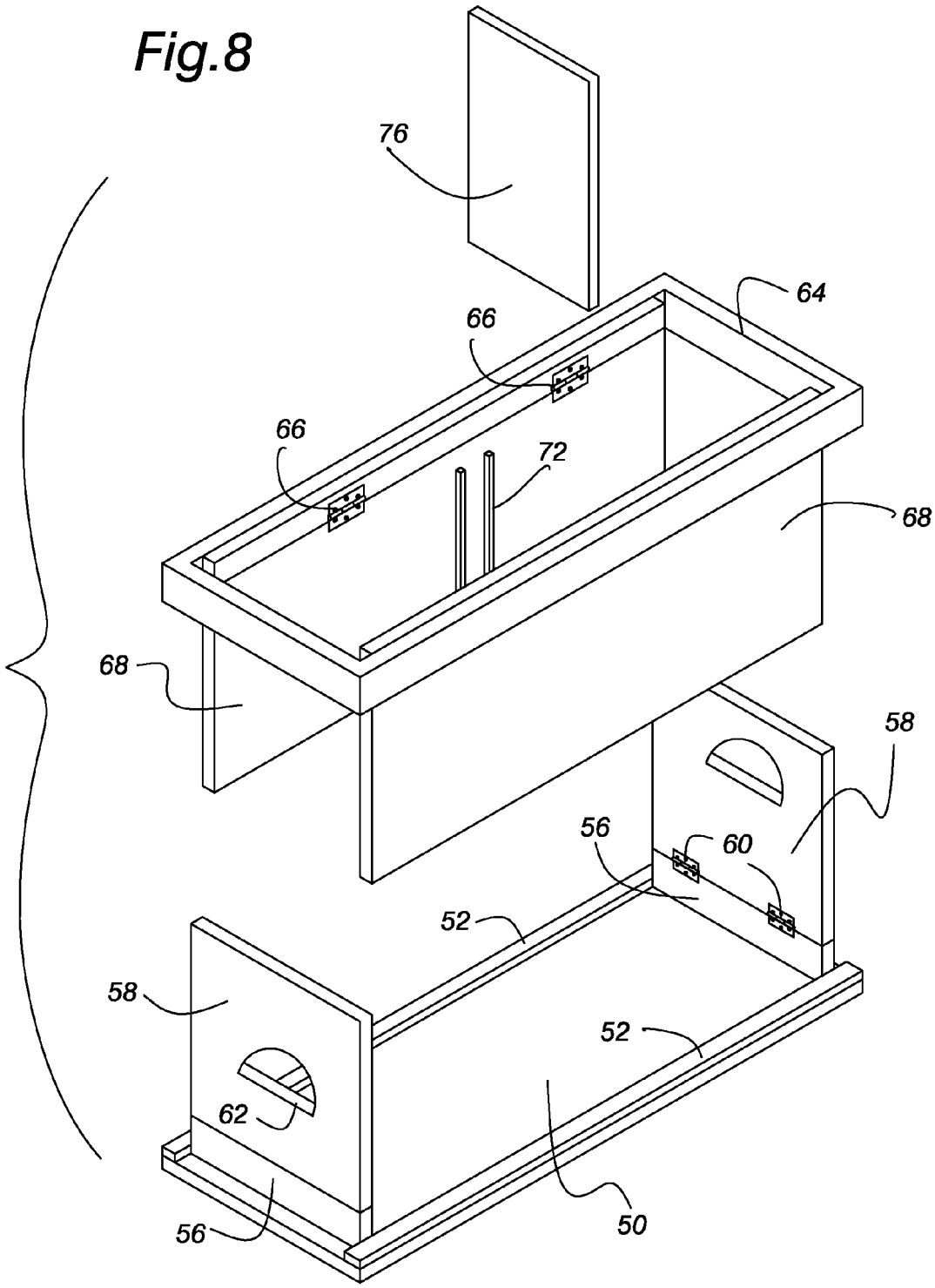
FIG. 8 is an exploded perspective view of the storage box without an optional lid to better illustrate the manner in which the component parts of the storage box fit together.
Figure 9:
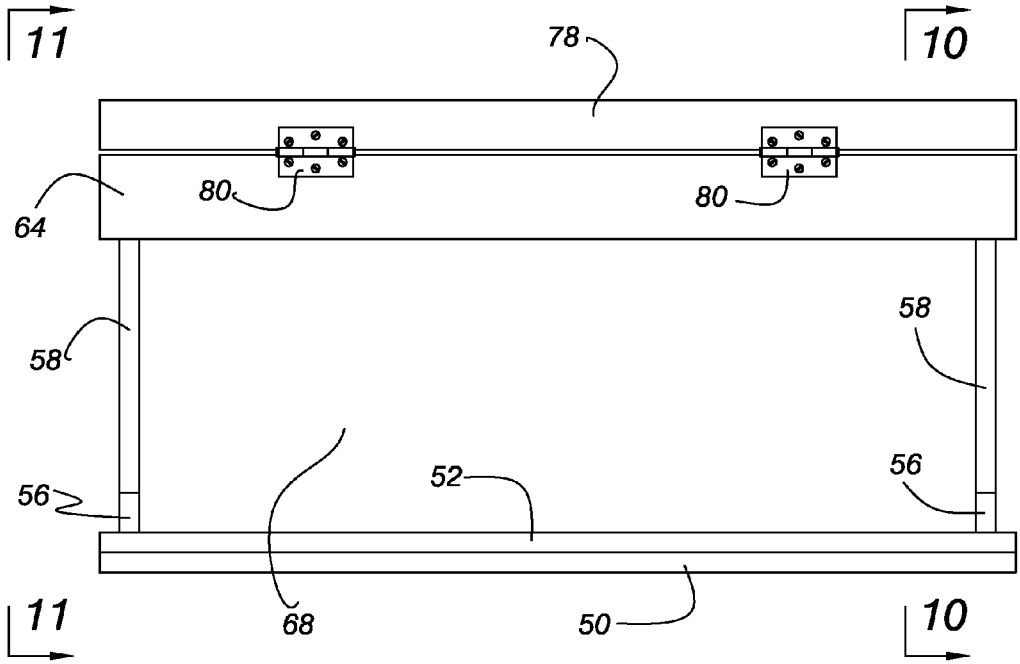
FIG. 9 is a rear elevational view of the storage box.
Figure 10:
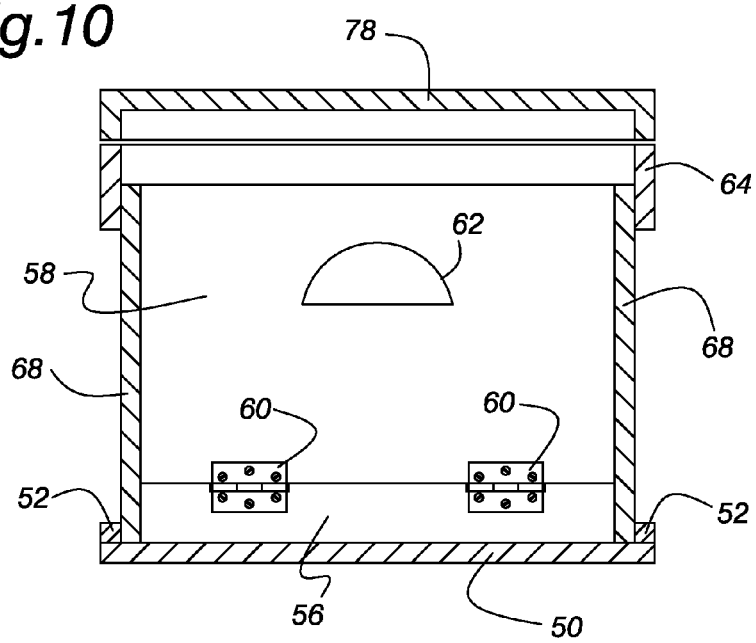
FIG. 10 is a sectional view taken along line 10-10 of FIG. 9 in the direction of the arrows.

Many of the foregoing features of the invention as applied to an upright, vertical storage locker may be adapted for use in a horizontally oriented footlocker or file storage box as illustrated in FIGS. 7 through 14. FIG. 8 is an exploded view of the footlocker or storage box to provide an understanding of how the unit interlocks when assembled.

Beginning at the bottom of the storage box, there is provided a rigid, base wall 50 having a preselected width and height for a conveniently sized footlocker or a file storage box. Joined to the opposed side edges of the base wall 50 are opposed rail members 52. Attached to the base wall 50 in proximity to the ends thereof are opposed spacer members 56.

End walls 58 are connected by hinges 60 to the opposed spacer members 56 extending from the base wall 50. End walls 58 may include handle openings 62 therethrough to assist in lifting and carrying the storage box.

Figure 15:
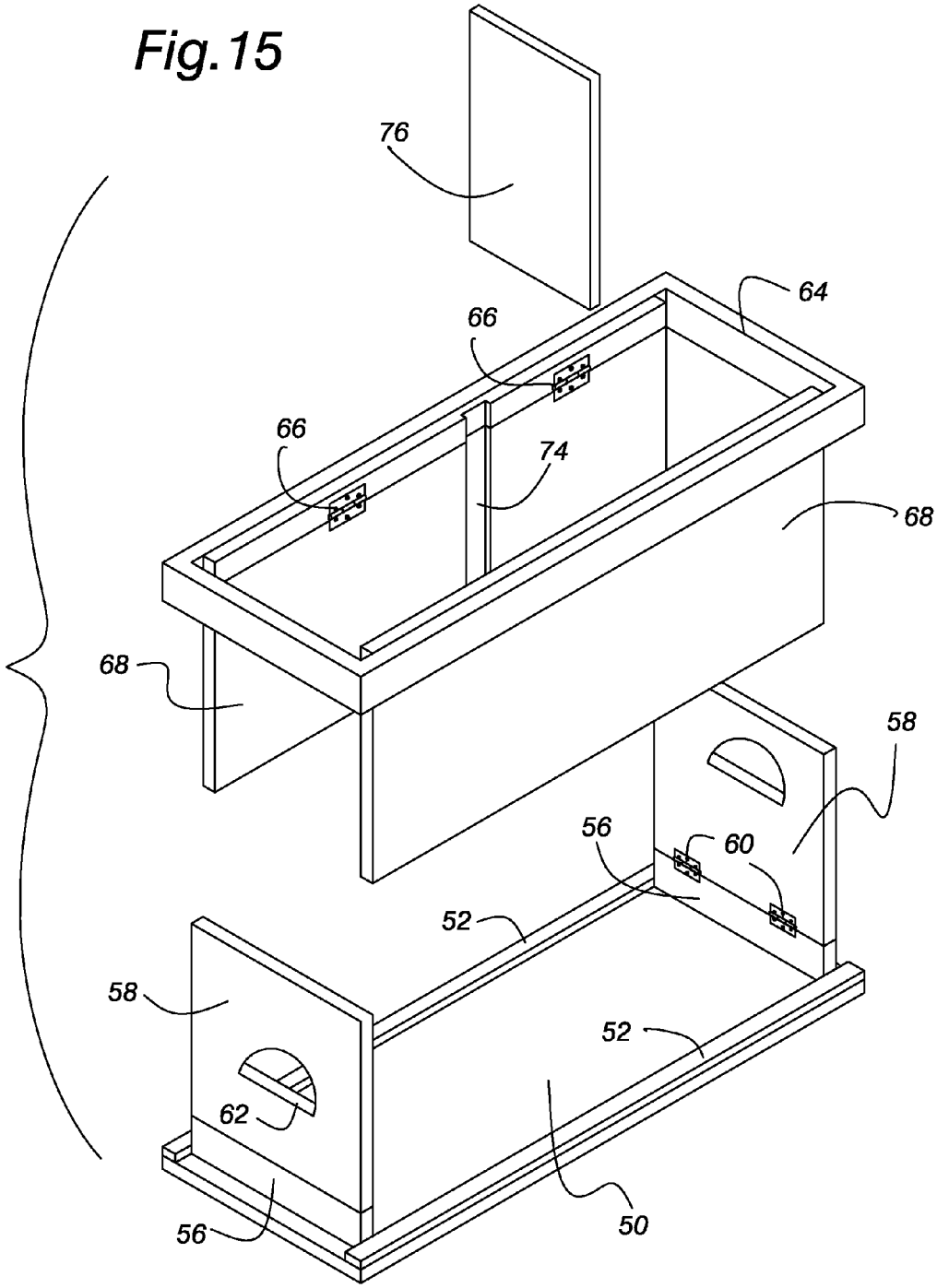
FIG. 15 is an exploded perspective view similar to FIG. 8 but illustrating an alternative configuration between the divider panel and the side walls of the storage box.

Moving upwardly from the base wall 50 to the second assemblage shown in FIG. 8, the storage box includes an integral upper frame 64 generally of rectangular shape, and being longer than it is wide as is characteristic of a convenient footlocker or file storage box. Mounted by hinges 66 to pivot inwardly on the interior sides of the upper frame 64 are a pair of opposed side walls 68. On the interior surfaces of the side walls 68 are secured a set of guide rails 72 at a central location along the width of the side walls 68. As an alternative to the guide rails 72, and if the side walls 68 are sufficiently thick, the side walls 68 may include opposed channel grooves 74 as shown in FIG. 15 to serve essentially the same purpose as the guide rails 72 as will become apparent in the description to follow.

Received by the opposed guide rails 72, or the opposed channel grooves 74, is a divider panel 76 having sufficient width to keep the side walls 68 spaced apart in a parallel relationship at a distance slightly less than the width of the end walls 58. Thus, the divider wall 76, when in place between the side walls 68 prevent the side walls 68 from folding inwardly, and the ends of the side walls 68 in turn prevent the end walls 58 from folding inwardly.

As shown in FIG. 7, the storage box may include an optional lid 78 if it is desired to have a closure for the storage box. The lid 78 is mounted by hinges 80 to the exterior of the upper frame 64.

In order for the three assemblages of FIG. 8 to be brought together in interlocking relationship and to permit subsequent collapse of the storage box, a number of critical dimensional relationships exist between the parts. Those will now be discussed.

First, the width of the side walls 68 must be less than the width of the base wall 50 and substantially equal to the distance between the end walls 58 so that each of the side walls 68 overlie the base wall 50 between the opposed rails 52 when in the collapsed or stowed condition. Also, the height of the hinged portion of the side walls 68 must be less than the width of the base wall 50 so that each of the side walls 68 fit between the opposed rail members 52 when in the stowed condition.

Second, the width of the end wall panels 18 must likewise be less than the width of the base wall 50 and the height of the end panels 18 must be less than or equal to one half height of the base wall 50 in order to overlie the side walls 68 when in the collapsed condition.

Third, in order to set the end walls 58 out from the base wall 50 a sufficient distance to fold on the hinges 60 and overlie the side walls 68 in the stowed condition, the spacer members 56 must extend from the base wall 50 a distance at least equal to twice the maximum thickness of the side walls 68. In the case of the side walls 68 equipped with guide rails 72, the maximum thickness of the side walls 68 would be the thickness of the panel material forming the side walls 68 themselves plus the thickness of the guide rails 72. In the case of the side walls 68 having channel grooves 74 to receive the divider panel 76, the maximum thickness of the side walls 68 is just the thickness of the panel material forming the side walls 68.

Fourth, the upper frame 64 must provide an open width at least equal to the width of the end walls 58 and an open height at least equal to the width of the side walls 68 plus twice the thickness of the end walls 58.

And lastly, the width of the divider panel 76 must be sufficient to span the distance between the side walls 68 when in the assembled condition in order to maintain the side walls in a substantially parallel relationship with the lower edge of each side wall 68 biased against the adjacent rail member 52.

In operation, going from the fully assembled condition as shown in the drawings to the collapsed condition, the lid 78, if present in the construction, is first opened and the divider panel 76 is removed. Next, the side walls 68 are folded inwardly so they are substantially parallel rather than perpendicular to the base wall 50. The upper frame 64 and the now folded side walls 68 are then pushed toward the base wall 50 until the folded side walls 68 overlie the base wall 50 in close proximity. At this point, the end walls 58 extend through the open width of the upper frame 64. When the upper frame 64 and the folded side walls 68 are pushed to a point where the side walls 68 are fully between the spacer members 56, then the end walls 58 may be folded inwardly on their respective hinges 60 to overlie the side walls 68. The divider panel 76 can now be placed flat within the open width and height of the upper frame 64 and the lid 78, if present, can be closed once again thereby completing the steps necessary to bring the storage box to its stowed condition.

Assembly from the stowed condition is basically the reverse of the foregoing process. The lid 78 is opened and the divider panel 76 is removed. Next, the end walls 58 are folded outwardly until they are oriented substantially perpendicular to the base wall 50. The upper frame 64 and the folded side walls 68 are then moved away from the base wall 50 until the side walls 68 can be folded outwardly to engage the rail members 52 on the base wall 50. The divider panel 76 is then inserted between the side walls 68 to lock them against the rail members 52. The ends of the side walls 68 then lock the end wall 58 from folding inwardly.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A collapsible storage container comprising:

a horizontally oriented, rigid rectangular base wall panel having a width ($w_1$) and height ($h_1$);

a pair of opposed, vertically oriented and spaced apart, rigid end wall panels each having a width ($w_2$), height ($h_2$) and thickness ($t_2$), said width ($w_2$) of each said end wall panels being less than the width ($w_1$) of said base wall panel and said height ($h_2$) of each said end wall panels being less than one half the height ($h_1$) of said base wall panel;

a pair of opposed, vertically oriented and spaced apart, rigid side wall panels each having a width ($w_3$), height ($h_3$) and maximum thickness ($t_3$), said width ($w_3$) of each said side wall panels being substantially equal to the distance between said end wall panels and said height ($h_3$) of each said side wall panels being less than the width ($w_1$) of said base wall panel;

a pair of opposed spacers attached to said base wall panel at opposite ends thereof at a distance substantially equal to the width ($w_3$) of said side wall panels, each said spacer extending from said base wall panel a distance at least equal to twice the maximum thickness ($t_3$) of said side wall panels;

first hinge members interconnecting said end wall panels to said opposed peripheral spacers to permit said end wall panels to fold inwardly toward said base wall panel;

an open, horizontally oriented, rectangular upper frame which spans a open width ($w_4$) and open height ($h_4$), said open width ($w_4$) of said frame being substantially equal to the width ($w_2$) of said end wall panels and said open height ($h_4$) being substantially equal to the width ($w_3$) of said side wall panels plus twice the thickness ($t_2$) of said end wall panels;

second hinge members interconnecting said side wall panels to opposed sides of said upper frame at a distance beneath the uppermost perimeter of said upper frame to permit said side wall panels to fold inwardly toward said upper frame, said side wall panels being centrally positioned and aligned on said frame such that when said side wall panels fold inwardly opposite ends of said side wall panels are spaced apart from opposed sides of said frame a distance substantially equal to the thickness ($t_2$) of said end wall panels; and a horizontally oriented, rigid closure lid hingedly mounted on said upper frame to span the open width ($w_4$) and open height ($h_4$) of said frame;

whereby in a collapsed condition, said side wall panels fold inwardly toward said upper frame and said end wall panels fold inwardly to overlie said side wall panels when said upper frame and said folded side wall panels are positioned in close proximity to said base wall panel.

2. The collapsible storage container as in claim 1, said base wall panel having a pair of peripheral side rails attached thereto and spaced apart by a distance substantially equal to the width ($w_2$) of said end wall panels, and the collapsible storage container further including a set of opposed guide rails secured interiorly on said side wall panels and a rigid divider panel inserted between said set of opposed guide rails, said divider panel having a width substantially equal to the spaced apart distance of said side wall panels in order to lock said side wall panels to engagement with the side rails of said base wall panel, whereby the ends of said side wall panels lock said end wall panels to engagement with the ends of said upper frame.

3. The collapsible storage container as in claim 1, said base wall panel having a pair of peripheral side rails attached thereto and spaced apart by a distance substantially equal to the width ($w_2$) of said end wall panels, and the collapsible storage container further including a set of opposed channel grooves in said side wall panels and a rigid divider panel inserted into said set of opposed channel grooves, said divider panel having a width substantially equal to the spaced apart distance between said channel grooves in order to lock said side wall panels to engagement with the side rails of said base wall panel, whereby the ends of said side wall panels lock said end wall panels to engagement with the ends of said upper frame.

* * * * *